US007568944B1

(12) United States Patent
Linan

(10) Patent No.: US 7,568,944 B1
(45) Date of Patent: Aug. 4, 2009

(54) COMPRESSION CONNECTOR FOR A COAXIAL CABLE

(76) Inventor: Gan Linan, No. 18 Xinghua Rd East, Ronggui, Shunde 528306 (CN)

( * ) Notice: Subject to any disclaimer, the term of this patent is extended or adjusted under 35 U.S.C. 154(b) by 48 days.

(21) Appl. No.: 11/863,551

(22) Filed: Sep. 28, 2007

Related U.S. Application Data

(60) Provisional application No. 60/853,212, filed on Oct. 20, 2006.

(51) Int. Cl.
*H01R 9/05* (2006.01)

(52) U.S. Cl. ..... 439/578

(58) Field of Classification Search ..... 439/578–585, 439/675, 909, 245, 63
See application file for complete search history.

(56) References Cited

U.S. PATENT DOCUMENTS 5,354,220 A * 10/1994 Ganguly et al. ..... 439/675
5,746,616 A * 5/1998 Mar ..... 439/245
2006/0258181 A1* 11/2006 Holland ..... 439/63
2007/0259565 A1* 11/2007 Holland ..... 439/578

* cited by examiner

*Primary Examiner*—Edwin A. Leon
(74) *Attorney, Agent, or Firm*—Laura N Tunnell

(57) ABSTRACT

The present disclosure describes a slotted compression ring for a coaxial cable connector. The connector comprises a tubular body portion having a leading end and a trailing end with a connector nut attached to the leading end thereof. The connector has a tubular shell slidably mounted over the trailing end of the body portion. The body portion further includes a tubular shank coaxially mounted therewithin and extending reanvardly from the leading end thereof. The slotted ring is removably diposed within an axial lumen in the shell. When a prepared end of a coaxial cable is inserted through the compression ring into body portion and the shell advanced over the body portion, the slotted ring buckes inwardly against the cable to securely hold the cable within the connector.

1 Claim, 1 Drawing Sheet

DRAWINGS

COMPRESSION CONNECTOR FOR A COAXIAL CABLE

This application claims priority of provisional application 60/853,212, filed Oct. 20, 2006.

BACKGROUND OF THE INVENTION

1. Field of the Invention

The present invention relates to a removable compression ring for a male coaxial cable connector.

2. Prior Art

Coaxial cable connectors are well known in the art. Coaxial cable connectors generally comprise a tubular body portion having a leading end, a trailing end and an axial lumen coextensive with the length of the body portion. A connector nut is attached to the leading end and a tubular shell is slidably attached to the trailing end of the body portion. In such connectors, a "prepared end" of a coaxial cable is inserted into an axial lumen within the shell and body portion of the connector and fully advanced thereinto. A tool is employed to compress the connector in a longitudinal direction until the cable is securely held within the body portion. To accomplish secure holding, a compression ring is slidably disposed within the axial lumen of the connector such that when the shell is forced forwardly toward the leading end of the body portion, the compression ring is radially and inwardly deformed to securely hold the cable within the connector.

There is a continuing need for compression rings that may be changed to accommodate various diameter coaxial cables, provide sufficient force for securely holding the cable and require minimal compressive force for effecting attachment.

SUMMARY

The present invention is directed to a compression ring for a coaxial cable connector that substantially obviates one or more of the limitations of the related art. To achieve these and other advantages and in accordance with the purpose of the invention, as embodied and broadly described herein, the invention includes a tubular compression ring having a length defining a longitudinal axis and a circumference. The ring further includes a plurality of longitudinal slots or perforated lines disposed around the circumference of the ring. The slots or perforated lines may be aligned parallel to or spiral about the longitudinal axis of the compression ring. When the ring is compressed in a longitudinal direction, the slots cause a portion of the ring disposed between the slots to buckle inwardly against the cable to prevent removal of the cable from the connector.

The features of the invention believed to be novel are set forth with particularity in the appended claims. However the invention itself, both as to organization and method of operation, together with further objects and advantages thereof may be best understood by reference to the following description taken in conjunction with the accompanying drawings.

DESCRIPTION

DESCRIPTION OF THE PREFERRED EMBODIMENTS

Figure 1:
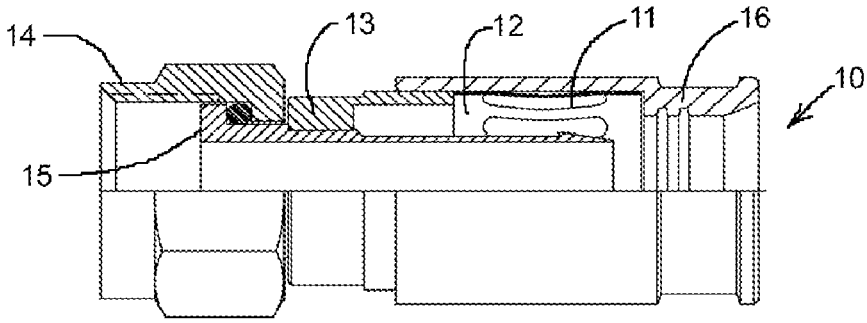
FIG. 1 is a longitudinal, partially cutaway view of a coaxial cable compression connector illustrating the disposition of the compression ring housed within the axial lumen of the connector reanvardly of the body portion.

FIG. 1 is a longitudinal, partially cutaway view of a coaxial cable compression connector 10 illustrating the disposition of the compression ring 11 housed within the axial lumen 12 of the connector 10 reanvardly of the body portion 13. The coaxial cable connector 10 further includes a connector nut 14 attached to the leading end of the body portion 13, and a tubular shank 15 extending rearwardly into the axial lumen 12 from the leading end of the body portion 13. The connector 10 further includes a shell 16 slidably attached to the trailing end of the body portion 13.

Figure 2:
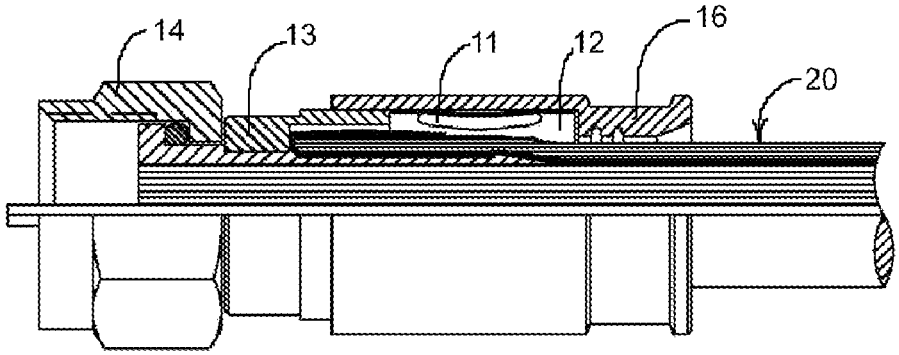
FIG. 2 is a longitudinal, partially cutaway view of a coaxial cable compression connector illustrating the disposition of the compression ring housed within the axial lumen of the connector reanvardly of the body portion with the prepared end of a coaxial cable inserted into the axial lumen of the connector.

Turning now to FIG. 2, the axial lumen 12 is dimensioned to permit the prepared end of a coaxial cable 20 to be inserted thereinto. FIG. 2 is a longitudinal, partially cutaway view of the coaxial cable compression connector 10 of FIG. 1 illustrating the disposition of the compression ring 11 housed within the axial lumen 12 of the connector 10 rearwardly of the body portion 13 with the prepared end of a coaxial cable 20 inserted through the shell 16 and ring 11 into the axial lumen 12 of the connector.

Figure 3:
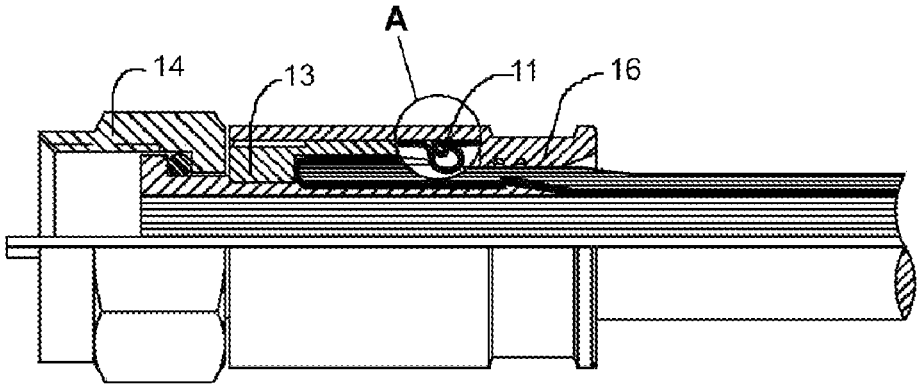
FIG. 3 is a longitudinal, partially cutaway view of a coaxial cable compression connector of FIG. 2 illustrating the inward deformation of the compression ring against the cable when the shell is advanced over the body portion.
Figure 3A:
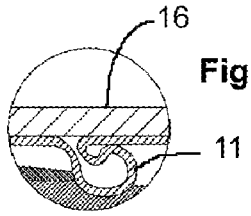
FIG. 3*a* is an enlarged side view of the compression ring following compression of the connector illustrating the deformation of the ring.
Figure 4:
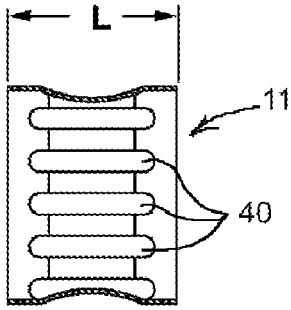
FIG. 4 is a side elevational view of a compression ring in accordance with a preferred embodiment of the present invention.
Figure 5:
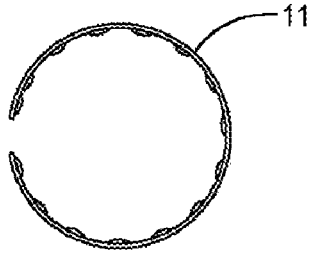
FIG. 5 is an end view of a compression ring in accordance with the preferred embodiment of the present invention shown in FIG. 4.

FIG. 3 is a longitudinal, partially cutaway view of a coaxial cable compression connector 10 of FIG. 2 illustrating the inward deformation of the compression ring 11 against the cable 20 when the shell 16 is advanced over the body portion 13. Since the compressed ring 11 cannot deform outwardly because it is constrained by the shell 16, the ring deforms radially inwardly to compress the cable 20 against the tubular shank 15. An enlarged view of the deformed ring 11 is shown in FIG. 3*a*. FIG. 4 is a side elevational view of a compression ring 11 in accordance with a preferred embodiment of the present invention. The compression ring 11 has a length L, a circumference and a plurality of discrete longitudinal slots 40 disposed around the circumference. FIG. 5 is an end view of a compression ring in accordance with the preferred embodiment of the present invention shown in FIG. 4.

The artisan will appreciate that simple perforated lines could replace the longitudinal slots 40 to effect the same goal. In general, any linear arrangement of openings of appropriate shape and dimension spaced about the circumference could be used. Moreover, the slots or other linear arrangement need not be strictly parallel to the longitudinal axis but may be have a spiral configuration.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What I claim is:

1. A compression ring for a coaxial cable connector, the coaxial cable connector comprising a tubular shell and a tubular body portion, said tubular shell having a leading end, a trailing end and an axial lumen, said leading end of said tubular shell being slidably attached to and overlying a trailing end of said tubular body portion, said compression ring being a generally tubular member disposed within said axial lumen of said tubular shell and having an outer cylindrical surface, a leading end, a trailing end and a length therebetween wherein a mid-portion of said length has a plurality of longitudinal slots spaced about said outer surface of said compression ring, wherein when an end of a coaxial cable is inserted through said axial lumen in said compression ring and said compression ring is longitudinally compressed by advancing said tubular shell toward a leading end of said body portion, said mid-portion of said compression ring buckles radially inwardly against said coaxial cable without deforming said leading end and said trailing end of said compression ring.

* * * * *